US005539938A

United States Patent [19]

Tubbs

[11] Patent Number: 5,539,938

[45] Date of Patent: Jul. 30, 1996

[54] WATER CLOSET

[76] Inventor: Elton H. Tubbs, 162 N. Portage St., Westfield, N.Y. 14787

[21] Appl. No.: 538,905

[22] Filed: Oct. 4, 1995

Related U.S. Application Data

[63] Continuation-in-part of Ser. No. 163,006, Dec. 8, 1993, abandoned.

[51] Int. Cl.[6] ..... E03D 9/05; E03D 1/14

[52] U.S. Cl. ..... 4/325.000; 4/348; 4/350; 4/415; 4/213

[58] Field of Search ..... 4/316, 324, 325, 4/328, 348, 349, 350, 351, 366, 367, 415, 431, 432, 433, 213, 216

[56] References Cited

U.S. PATENT DOCUMENTS

| | | | |
|---|---|---|---|
| 255,485 | 3/1882 | Boyle | 4/328 |
| 558,130 | 4/1896 | Wallace | 4/328 |
| 3,568,216 | 3/1971 | Valdespino | 4/349 |
| 3,732,579 | 5/1973 | Allander et al. | 4/431 |
| 3,908,204 | 9/1975 | Hopkins | 4/324 |
| 4,159,550 | 7/1979 | Tobin, Jr. | 4/431 |
| 4,297,751 | 11/1981 | Olin et al. | 4/415 |
| 4,318,192 | 3/1982 | Williams et al. | 4/216 |
| 4,407,025 | 10/1983 | Hennessy et al. | 4/415 |
| 4,692,951 | 9/1987 | Taki et al. | 4/213 |
| 4,713,847 | 12/1987 | Oldfelt et al. | 4/316 |
| 4,800,596 | 1/1989 | Menge | 4/348 |
| 4,880,027 | 11/1989 | Menge | 4/351 |
| 4,908,886 | 3/1990 | Barrett, Sr. et al. | 4/325 |
| 4,989,277 | 2/1991 | Tsutsui et al. | 4/367 |
| 5,123,124 | 6/1992 | Brower | 4/324 |
| 5,140,712 | 8/1992 | Wang-On | 4/415 |

FOREIGN PATENT DOCUMENTS

| | | | |
|---|---|---|---|
| 256730 | 10/1970 | Japan | 4/415 |

*Primary Examiner*—Henry J. Recla
*Assistant Examiner*—Charles R. Eloshway
*Attorney, Agent, or Firm*—The Law Offices of Byron A. Bilicki, P.C.

[57] ABSTRACT

A toilet flushing apparatus. The toilet flushing apparatus includes a vacuum fan for generating a partial vacuum for transporting solid and liquid waste from a toilet bowl to a sewer drain, a sensor for detecting a level of flushing water in the toilet bowl, a selector for selecting a defecation flushing node and a urination flushing mode, and a control, including a solenoid, for controlling time operation of time vacuum fan. The solenoid is responsive to a signal from the selector for supplying a relatively large amount of flushing water in the defecation flushing mode, as well as responsive to a signal from the sensor for supplying a relatively small amount of flushing water in the urination flushing mode.

3 Claims, 4 Drawing Sheets

WATER CLOSET

CROSS REFERENCE TO RELATED APPLICATION

This application is a continuation-in-part of U.S. application Ser. No. 08/163,006, filed on Dec. 8, 1993, entitled "Water Closet," now abandoned.

BACKGROUND OF THE INVENTION

This invention relates to flush toilets and more particularly to flush toilets requiring a minimum of water, yet having the maximum in utility and simplicity. Low water consumption toilets are known, many of which use a flush tank that require a small amount of water. Applicant's water closet controls the amount of water used.

U.S. Pat. No. 4,086,668 was issued on May 2, 1978 to Elton H. Tubbs, the present inventor, on an electrically controlled water closet. The toilet bowl was conventional, but it did not have a flush tank.

Applicant is also aware of the following U.S. Pat. Nos. 2,881,450 to Elton H. Tubbs; 3,224,013 to Elton H. Tubbs; 2,793,371 to LeVesconte; 3,044,077 To Belden; 3,047,013 to Baumback; 3,591,869 to Manning; 3,901,265 to Groonbrigde and 3,967,645 to Gregory.

SUMMARY OF THE INVENTION

This invention is an improvement over the water closets shown in the above patents in that two small electric vacuum fans are used. One that is started first to pull the odor from bowl rim of the water closet and vent it down the sewer to the outside vent. The venting shuts off when the solids flush push button switch is pushed to add one gallon of water to the two quarts in the bowl and complete the flushing cycle. A second small electric fan is used that creates a vacuum in the air trapped between the bowl and the second trap that pulls the water over the spillway and gravity takes over dumping the water down through the second trap into the sewer. The bowl is then filled with two quarts of water. A second flush button is provided for the urinal flush which flushes the two quarts of water in the bowl and then refills the two quarts thereby saving a gallon of water.

(1) Vacuum flushing makes it possible to use six quarts of water maximum or as little as three or four quarts depending on local drainage and local codes.

(2) When the bowl has no water, the rinse control unit is re-activated to refill the bowl with two quarts of water automatically. A complete flushing cycle can take less that 20 seconds if normal water pressure is available.

(3) Two small electric vacuum fans are used; one high speed for flushing the bowl fast and one small electric vacuum for running at a slower speed than the other to vent the toilet bowl when using the solids flush. Both fan motors may be low voltage D C with battery back-up, if conditions require. The battery may run other relays and other components used in other controls.

(4) The water supply inlet may be located more than eleven and one half inches above the spillway, thereby complying with most plumbing codes. It is the object of the invention to provide a water closet that has both a solids flush and a urinal flush to reduce the water consumption. Another object of the invention is to provide a water closet that is simple in construction, economical to manufacture and simple to use. Another object of the invention is to provide a flush toilet unit in which a vacuum is applied to water in the sump by a suction fan to facilitate the flushing operation.

With the above and other objects in view, the present invention consists of the combination and arrangement of parts hereinafter more fully described, illustrated in the accompanying drawings and more particularly pointed out in the appended claims. It being understood that changes may be made in the form , size, proportions in minor details of construction without departing from the spirit or sacrificing any of the advantage of the invention.

DESCRIPTION OF PREFERRED EMBODIMENTS

Figure 1:
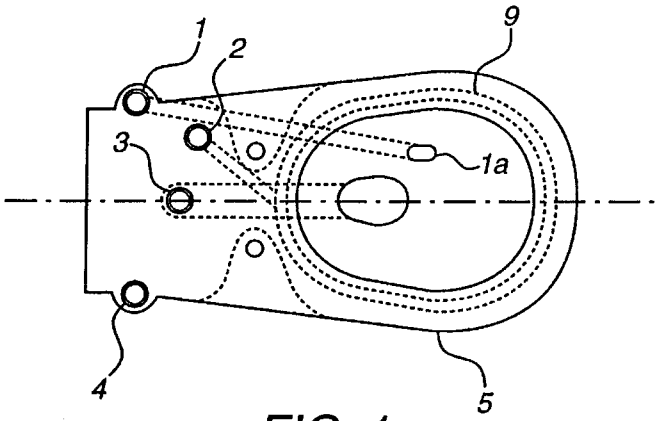
FIG. 1 is a top view of a water closet according to the invention.
Figure 2:
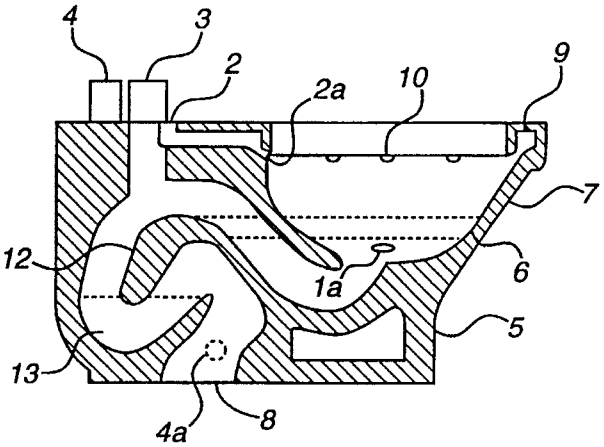
FIG. 2 is a longitudinal cross section view of a water closet according to the invention.
Figure 3:
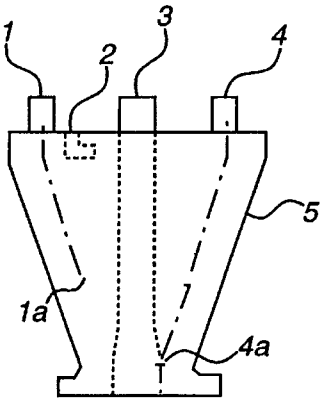
FIG. 3 is a end view according to the invention.

Now with more particular reference to the drawings, water closet 5 comprises bowl 7 having sump 6, drain line 8, water spray rim 9 with openings 10 connected to water spray rim 9 and spillway partition 12 between sump 6 and trap 13 and drain line 8.

Figure 4:
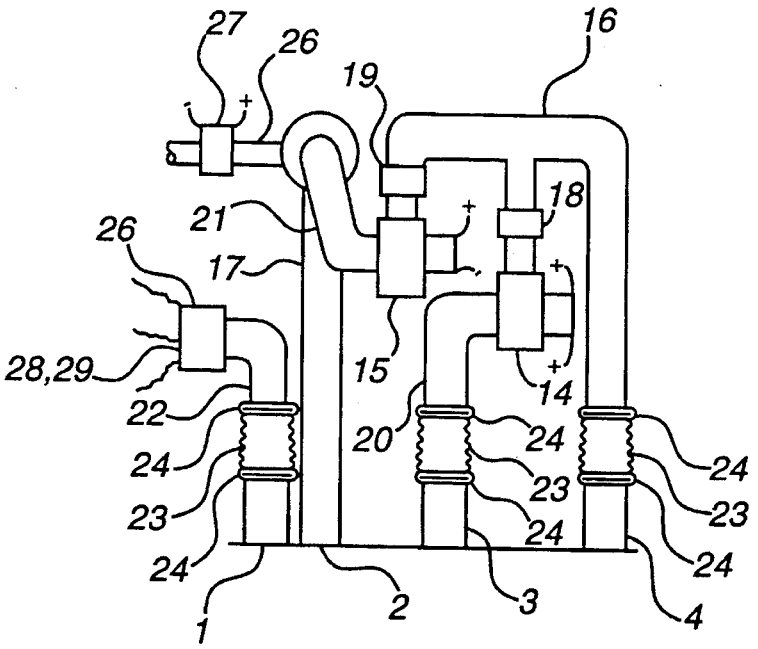
FIG. 4 is a view of the vacuum fans and piping.

FIG. 4 shows the piping arrangement which is housed in case 35 to direct the air and water flow from water closet 5 to the drain or vent.

Air passage **1-1*a* is connected to water level switch 25, pipe 22 and flexible hose 23 held by clamps 24**.

Standpipe 17 allows water to flow into the bowl 6 through water supply valve 27, through pipe 26 and down through passage **2-2*a* to water spray rim 9, and through water spray rim 9, through holes 10 to bowl 6. Push button venting switch 30 activates a first vacuum fan 15 which draws air from bowl 6 through air passage 2*a*-2, up standpipe 17, through venting pipe 21 and into fan 15. The air opens check valve 19 and goes through manifold 16, down through hose connection 23 to second vent passage 4-4*a* and drain 8**.

Figure 5:
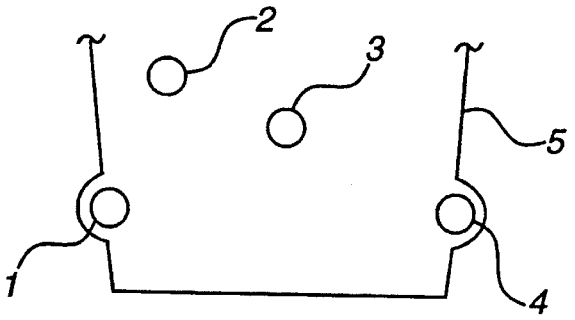
FIG. 5 ms a partial view of top of water closet.

FIG. 5 is a view showing locations of air and water passages 1–2–3 and 4.

Figure 6:
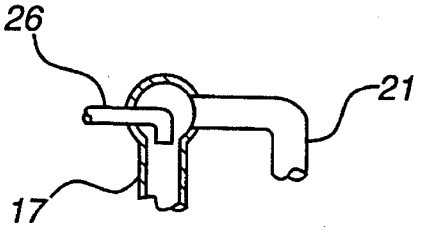
FIG. 6 is a view of the standpipe arrangement.

FIG. 6 is a longitudinal cross section of standpipe 17 and water supply pipe 26 with venting pipe 21.

Figure 7:
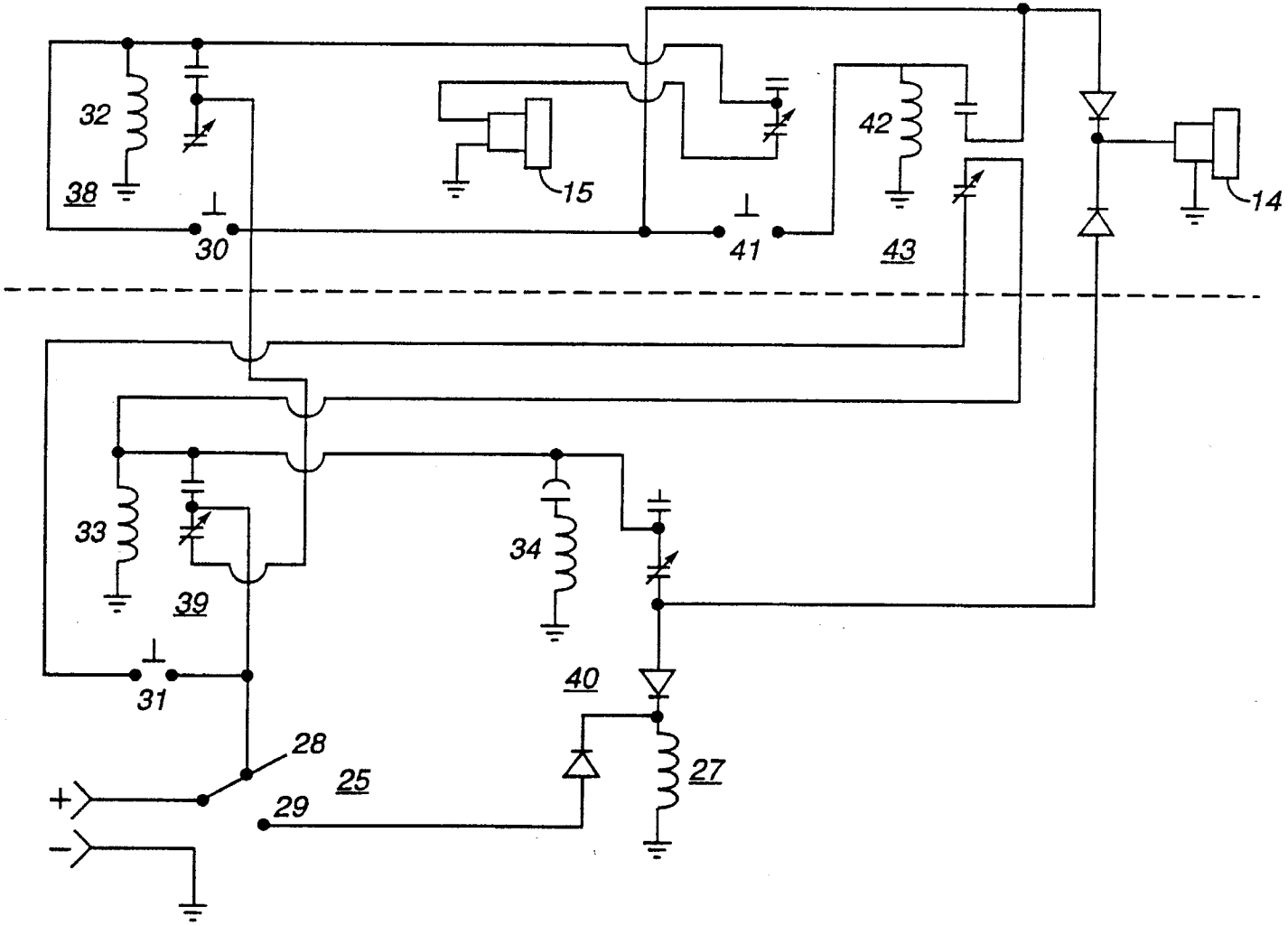
FIG. 7 is a schematic diagram of the wiring.

FIG. 7 shows a schematic wiring diagram of an example of an electrical circuit which may be housed in a case 35 to control the flushing of water closet 5. The electrical circuit includes first solenoid 32 of holding relay 38 for the venting cycle activated by venting switch 30 which activates first vacuum fan 15. The second push button is solids flush switch 31, which activates the second solenoid 33 of holding relay 39, diverting current away from first vacuum fan 15 and passing current to timing relay 34, which allows an effective amount of current to pass to electrically controlled water supply solenoid valve 27. The water supply valve 27 then opens, discharging one gallon of water into bowl. The push button switch 31 also activates second vacuum fan 14 to start the flushing of solids when third timing relay 34 of solenoid 40 is activated. Therefore, switch 31 activates both electrically controlled water solenoid 27 which causes the discharge of one gallon of water into bowl 6, and vacuum fan 14 which initiates the flushing cycle and pulls the water from bowl 6. After the fan 14 pulls all water from bowl 6, and bowl 6 is empty, pressure switch 25 is activated. The activation of pressure switch 25 diverts all current directly to electrically controlled water solenoid 27. Electrically controlled water solenoid 27 causes the discharge of 2 quarts of water into bowl 6. The water is discharged into bowl 6 by passing through water supply valve 27, pipe 26, standpipe 17, and passage way 2-2*a*. When the bowl 6 is empty pressure sensitive switch 25 activates the fourth timing relay 27 to refill bowl 6 with two quarts of water. The third push button is liquids flush switch 41, which activates the fifth timing relay 42 of solenoid 43 to the flush urinal cycle by activating vacuum fan 14. Once again, when bowl 6 is empty, pressure sensitive switch 25 is activated thereby diverting current from switches 30, 31 and 41, and sending current to electrically controlled water solenoid 27. Electrically controlled water solenoid 27 activates water supply valve 27 thereby filling bowl 6 with two quarts of water.

Figure 8:
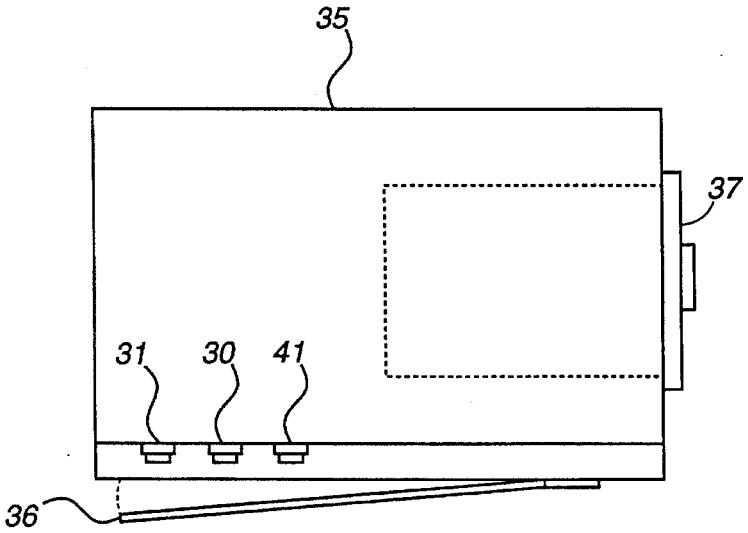
FIG. 8 is a top view of the case.

FIG. 8 top view of case 35 showing location of drawer 37 and access door 36.

Figure 9:
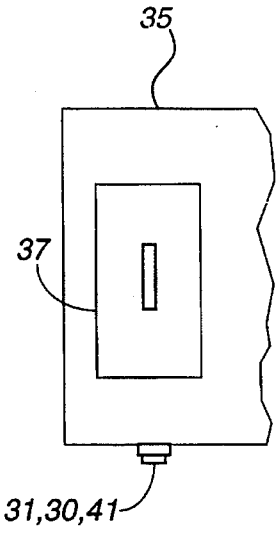
FIG. 9 is a end view of the case.

FIG. 9 is a partial end view.

Figure 10:
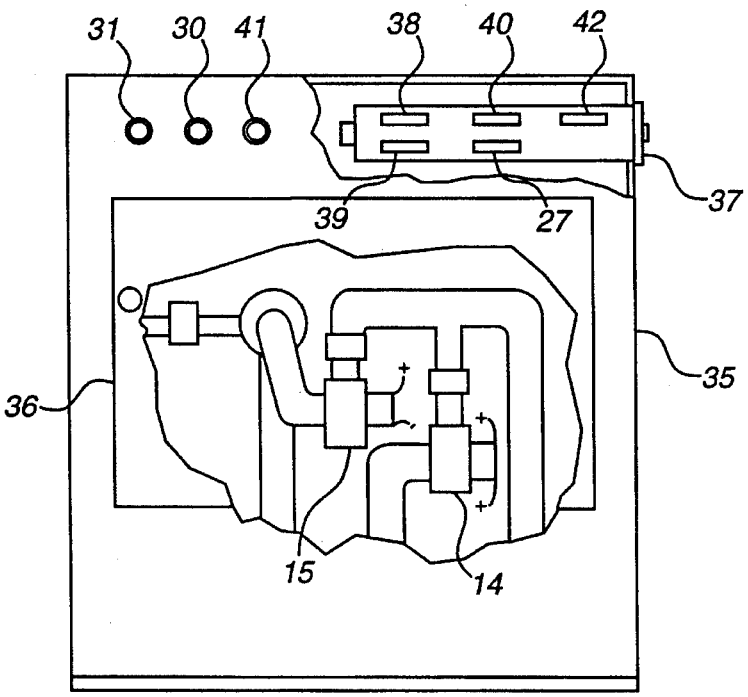
FIG. 10 is a front view of the case.

FIG. 10 is a front view locating push button switches 31, 30, and 41 and the schematic wiring in the drawer 37 for easy access.

VENTING CYCLE

The venting cycle is first started by push button venting switch 30, which activates holding relay 32 of solenoid 38 that powers vacuum fan 15, the air is removed from the toilet bowl 6 through the holes 10 in the bowl ring 9, through the vent line 2-2*a*, through standpipe 17, and venting pipe 21 by vacuum suction fan 15, opening check valve 19 to allow the air to flow through manifold 16. Check valve 18 remains closed forcing the air down through the second vent passage 4-4*a* to drain 8 and out the house vent.

URINAL FLUSH

The urinal cycle is started by push button liquids flush switch 41 which activates holding relay 42 of solenoid 43 that powers vacuum fan 14. Vacuum fan 14 pulls a vacuum between the trap in bowl 6 and the second trap 13 up through a first vent passage 3 and pipe 20, and through the vacuum fan 14. The air is sucked through vacuum fan 14, thereby creating the vacuum, and is evacuated through check valve 18 while check valve 19 remains closed, through the manifold 16 and down through second vent passage 4-4*a* to the sewer line 8. The water is pulled over spillway 12 and when the bowl 6 is empty the water level switch 25 will open all circuits except electric controlled water solenoid 27 which refills the bowl 6 with two quarts of water.

SOLIDS FLUSH

The solid's flush is started by push button solids flush switch 31, which engages holding relay 33 of solenoid 33 cutting the current to solenoid 38 of the venting cycle and vacuum fan 15, and activating timing relay 34 of solenoid 40 and solenoid valve 27. The timing relay 34 is calibrated such that solenoid valve 27 is kept open for a predetermined period of time for regulating an amount of water, preferably one gallon, to be added to the two quarts of water previously in bowl 6. Timing relay 34 may be calibrated by determining the flow rate of water through water supply pipe 26, which is a function of measurable input water pressure, and calculating the period of time required to allow one gallon of water to pass through solenoid valve 27.

Maintenance operations are simplified by the provision of a case 35 having a drawer 37 for allowing quick access to the electrical control circuitry contained therein, and access door 36 for permitting easy access to the plumbing contained within case 35. The control circuitry is preferably operated on a low voltage potential powered using batteries or an alternating current outlet.

As may be appreciated from the above description, the water closet according to the present invention offers several advantages over prior art water closets. The advantages include a venting cycle which may be started by a user when first using the invention for the removal of odor from bowl 6; user selectable liquid and solid flush cycles which use relatively small and large amounts of water for water conservation; the elimination of a holding tank by use of electric vacuum fan 14 to exert suction on the air trapped between bowl 6 and trap 13, which causes the water in bowl 6 to flow over spillway 12, through the trap 13 and out through sewer drain 8; and a flush cycle which may be less than 20 seconds in duration where normal water pressure is available, thus reducing the lengthy sound of running water associated with the filling of a conventional holding tank.

I claim:

1. A water closet comprising:

a bowl for receiving waste;

water supply means for supplying flushing water to said bowl, said water supply means including a water supply pipe and an electric solenoid valve for controlling flow through said water supply pipe for regulating the amount of flushing water supplied to said bowl;

a trap pipe connecting said bowl to a sewer drain, said trap pipe extending laterally from said bowl for siphoning flushing water which has been supplied to said bowl by said water supply means and defining (i) a first trap arranged such that a relatively shallow body of waste is retained in said bowl for preventing gaseous communication through said first trap; (ii) a second trap of sufficient height so as to prevent a reverse flow of sewer gas from said sewer drain into said trap pipe; and (iii) a spillway partition connecting said first trap and said second trap;

a first vent passage comprised of a first end and a second end, wherein said first end communicates with said spillway partition;

a stand pipe comprised of a first end and a second end, wherein said first end is connected to said toilet bowl;

a venting pipe comprised of a first end and a second end, wherein said first end communicates with said stand pipe;

a manifold comprised of a first end and a second end, wherein said first end communicates with said second end of said venting pipe, and said second end of said first vent passage communicates with said manifold at a point between said first and second ends thereof;

a second vent passage comprised of a first end and a second end, wherein said first end communicates with said second end of said manifold and said second end communicates with said sewer drain;

a first vacuum fan disposed at a junction of said second end of said venting pipe and said first end of said manifold for withdrawing contaminated air from said bowl;

a second vacuum fan disposed in said first vent passage for generating a partial vacuum for transporting solid and liquid waste from said bowl to said sewer drain;

pressure sensor means for detecting an absence of water in said bowl and signaling said solenoid valve to remain open for a period to supply a first predetermined amount of flushing water to said bowl; and control means having a venting switch operable by a user for activating said venting means, a liquids flush switch operable by a user for activating said vacuum fan to empty said bowl, and a solids flush switch operable by a user for activating said vacuum fan to empty said bowl, said solids flush switch further being connected to said solenoid valve by a timing relay calibrated for signaling said solenoid valve to open for a period to supply an additional predetermined amount of flushing water to said bowl.

2. The water closet according the claim 1, wherein said first amount of flushing water is two quarts.

3. The water closet according to claim 1, wherein said additional amount of flushing water is one gallon.

* * * * *